United States Patent [19]

Ulseth

[11] 4,319,742

[45] Mar. 16, 1982

[54] SHEET SUPPLY DETECTOR AND INDICATOR

[75] Inventor: John W. Ulseth, Roseville, Minn.

[73] Assignee: Minnesota Mining and Manufacturing Company, St. Paul, Minn.

[21] Appl. No.: 161,733

[22] Filed: Jun. 23, 1980

[51] Int. Cl.[3] ..... B65H 1/14; B65H 3/06; B65H 43/02

[52] U.S. Cl. ..... 271/118; 221/6; 271/127; 271/147; 271/DIG. 3

[58] Field of Search ..... 271/118, 127, 126, 147, 271/145, 152, 153, 154, 155, 156, 160, 162, 164, 256, 258, DIG. 3; 221/6; 340/612, 570

[56] References Cited

U.S. PATENT DOCUMENTS

| | | | |
|---|---|---|---|
| 2,124,223 | 7/1938 | Zaengle | 271/256 |
| 2,896,946 | 7/1959 | Barratt et al. | 271/126 X |
| 3,097,760 | 7/1963 | Short | 271/155 UX |
| 3,301,551 | 1/1967 | Cassano et al. | 271/153 |
| 3,446,496 | 5/1969 | Schwebel | 271/155 X |
| 3,525,517 | 8/1970 | Toby | 271/117 |
| 3,949,979 | 4/1976 | Taylor et al. | 271/117 X |

*Primary Examiner*—Bruce H. Stoner, Jr.

*Attorney, Agent, or Firm*—Cruzan Alexander; Donald M. Sell; Randall J. Gort

[57] ABSTRACT

A device for detecting and indicating a depletion of the supply of sheets in a sheet feeder of the type having a lifting arm used to lift the sheets toward a feeding member. The device utilizes the increased movement of the lifting arm due to the depleting stack to energize an indicator. The device also has the capability of utilizing magnetic members to latch the indicator in an energized condition until the supply of sheets is replenished, which then automatically de-energize the indicator.

6 Claims, 5 Drawing Figures

SHEET SUPPLY DETECTOR AND INDICATOR

TECHNICAL FIELD

This invention relates to a device for detecting and indicating the depletion of a supply of sheets within a sheet feeder.

BACKGROUND ART

For accomplishing the process of feeding sheets, a common sheet feeder design utilizes a support member, typically a tray or cassette containing a supply of sheets therein, which is biased toward a feeding member such as a friction-type roller. With this type of sheet feeder, the existence of a deficient supply of sheets supported by the support member can be detected by detecting the diminished weight of the depleted supply of sheets against the biasing force urging the sheets toward the friction roller (see e.g., U.S. Pat. No. 3,949,979. The desirability of this type of sheet feeder, however, is limited by certain problems described within a co-pending U.S. patent application for a Sheet Feeder filed concurrently and designated by Ser. No. 161,741, incorporated herein by reference. In light of these teachings it is desirable to have a device for detecting a depleted sheet supply, which does not depend upon the decreasing weight of the depleting supply of sheets. It is also desirable to have a device capable of providing an early warning of the depleting supply as well as an indication that the supply has been depleted. Finally, it is desirable to have a device which can easily be reset and which does not interfere with or make more difficult the process of replenishing the supply of sheets within the feeder.

DISCLOSURE OF THE INVENTION

The present invention is a simplified, cost-efficient, and reliable detection device which can be used with a sheet feeder similar to that described by the above-referenced co-pending U.S. patent application.

The device is designed to cooperate with a sheet feeder of the type wherein lifting means are utilized to lift the sheets within the sheet feeder away from a support member and toward a feed roller to afford the feed of a single sheet. Typically the support member is a cassette which stores sheets, as for example sheets of paper. As the sheets of paper within the cassette are being depleted, the lifting means are designed to experience a corresponding greater amount of travel toward the feed roller. It is this increased amount of travel which is detected by the present invention and utilized to indicate the depleting, and the depleted supply of paper within the cassette. The detection device of the present invention comprises indicator means positioned to alert an operator of the machine of the depleted paper condition, an actuator arm used to energize the indicator means, a connecting arm allowing the actuator arm to be engaged by the lifting means, and means for latching the actuating arm at a position where the indicator means are energized.

The indicator means of the present invention comprises a visible of audible signaling device such as a lamp which is capable of alerting an operator, and an appropriate electrical circuit having a switch which can energize or de-energize the signalling device. This switch is mechanically connected to the actuator arm, such that a pivotal movement of the actuator arm between first and second positions will correspond to the off and on states of the switch. The actuator arm is positioned to be engaged by the lifting means via the connecting arm so as to respond to the lifting motion of the lifting means taking place during the successive feeding cycles as well as to be released from the lifting means after the completion of a feeding cycle so as to not restrain the motion of said lifting means. The above elements are disposed such that as the sheets within the cassette are being depleted during the feeding cycles, the corresponding increased travel of the lifting means will ultimately cause the actuator arm to reach its second position and activate or energize the indicator means. During these successive feeding cycles the lifting means are allowed to drop downwards by gravity, restoring the actuator arm to its first position, and thus de-activating the indicator means. This activating and deactivating results in an intermittent energizing of the indicator means, and is a warning to the operator that the sheet supply is low and that sheets will soon need to be added.

The means for latching the actuator arm at its second position comprise a portion of a permanently magnitized material attached to the actuator arm, and a portion of a magnetic material attached to the bottom of the cassette. As the actuator arm approaches the cassette in response to the lifting motion of the lifting means during the sheet feeding cycles, it will ultimately reach a position where its proximity to the cassette will cause the magnetic forces between its magnetized portion and the magnetic portion on the cassette to latch these portions together. This latching causes the actuator arm to remain in its second position even after the lifting means are allowed to drop. The resultant continuous energizing of the indicator means signals a depleted paper condition to the operator, warning the operator that sheets must now be added prior to continuing the machine operation.

Thus the relationship between the sheet supply and the resulting proximity of the actuator arm to the cassette is utilized by this invention to intermittently energize the indicator at a time when the paper supply approaches an almost depleted condition, and to latch the indicator in an energized state when the paper supply is sufficiently depleted to require the addition of paper.

BRIEF DESCRIPTION OF DRAWING

The present invention will be further described hereinafter with reference to the accompanying drawing wherein.

DETAILED DESCRIPTION

Figure 1:
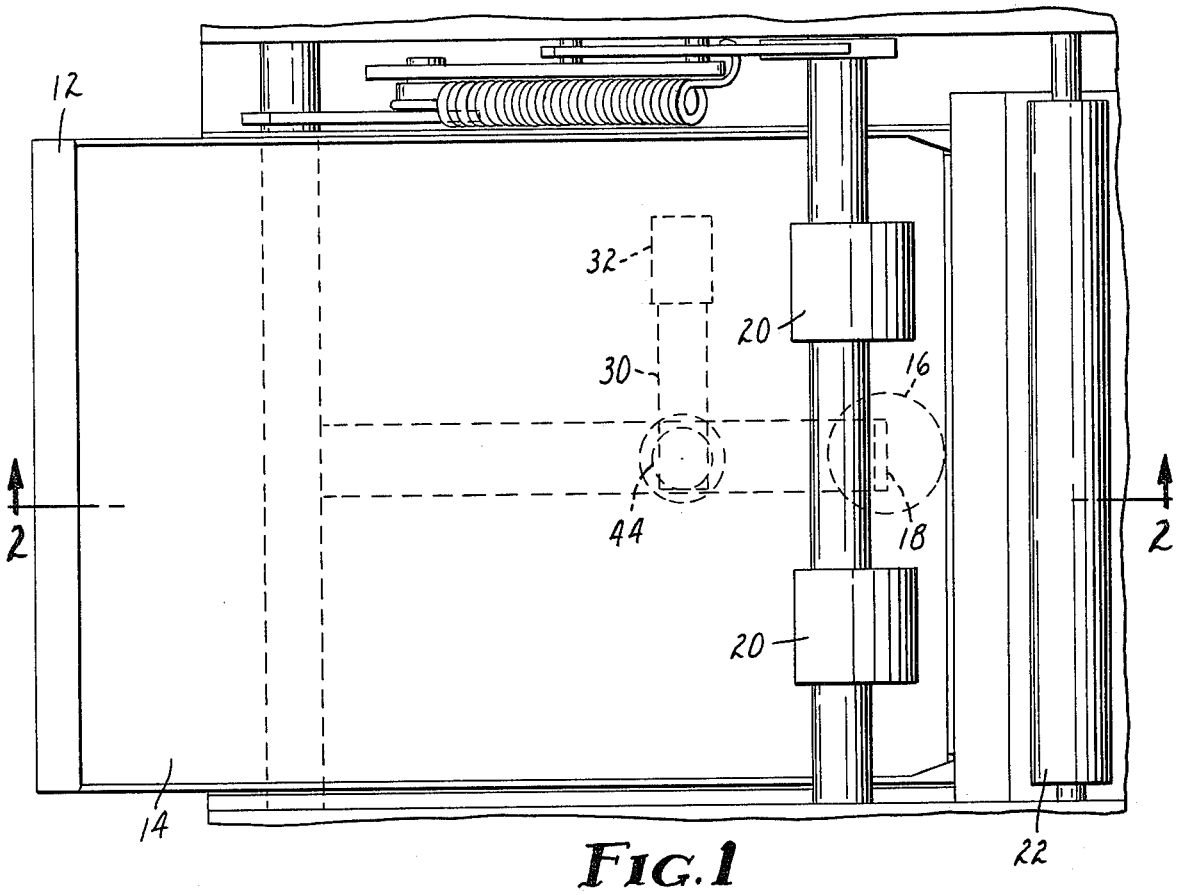
FIG. 1 is a top view of the device according to the present invention.
Figure 2:
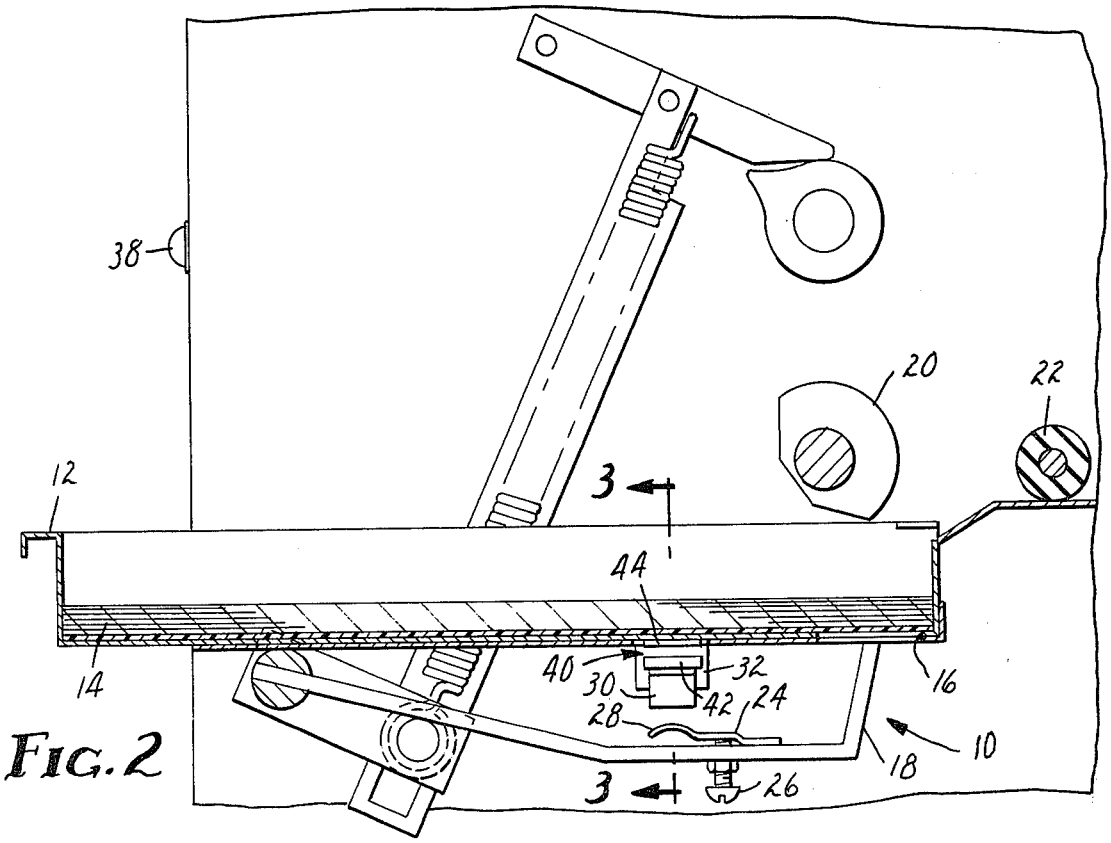
FIG. 2 is a longitudinal section taken along line 2—2 of FIG. 1, illustrating the device prior to an out-of-paper condition.
Figure 4:
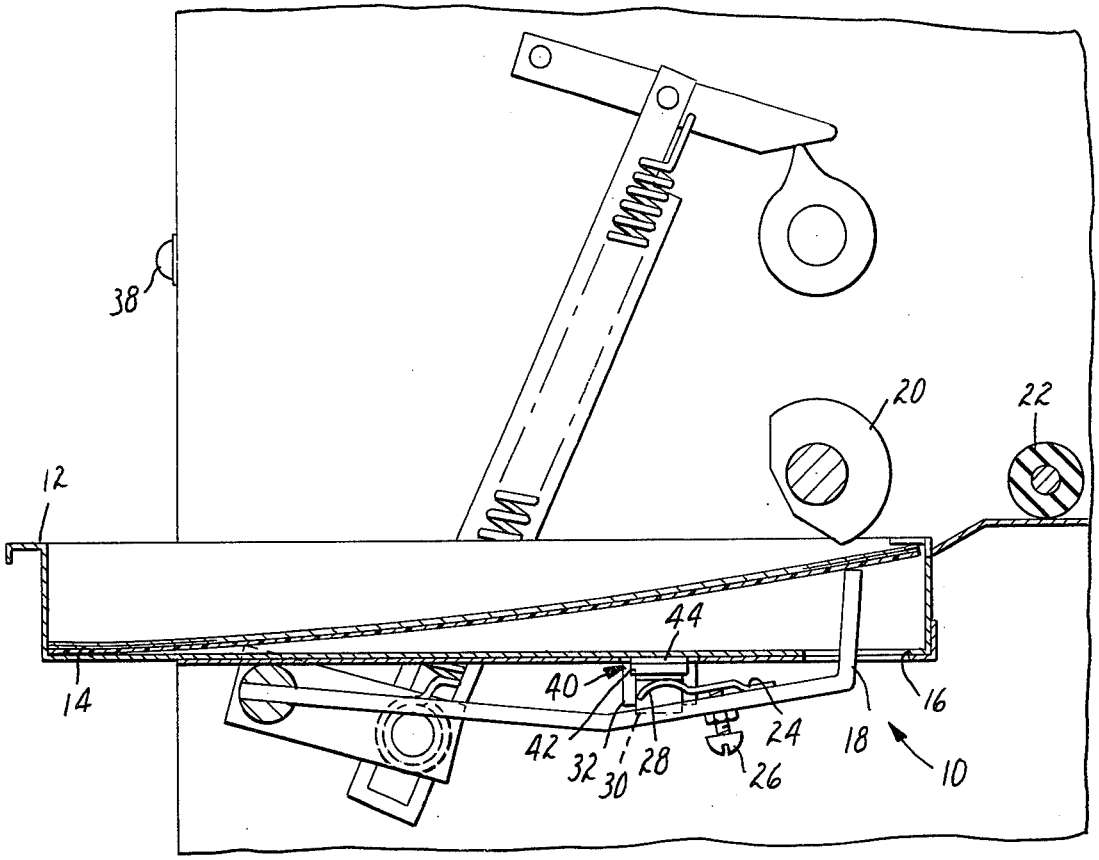
FIG. 4 is a sectional view as in FIG. 2, but illustrating the apparatus in a condition of requiring paper.

The out-of-paper detection device 10 of the present invention is used in combination with a paper feeder of a type utilizing a cassette 12 for holding a stack 14 of sheets of paper. The cassette 12 has an aperture 16 affording access to the bottom of the paper stack 14.

Lifting means 18 are disposed to cooperate with the cassette 12 by entering the aperture 16 to lift the paper stack 14 away from the bottom of the cassette 12 toward a feed roller 20. The feed roller 20 causes the uppermost sheet of paper to be advanced toward an urging roller 22 so as to be fed into an office machine such as a copying machine.

The operation of this paper feeder, as described in a co-pending application Ser. No. 161,741 inherently involves the movement of lifting means 18 to a position more proximate the feed roller 20 as the paper is diminished during each successive feeding cycle. The out-of-paper detection device 10 takes advantage of this movement and its relationship to the paper supply by mounting a connecting arm 24 on the lifting means 18. In the preferred embodiment, the connecting arm 24 is an elongate section of flat stock, metal or plastic, conventionally fastened at one end of the lifting means 18. An adjustment screw 26 or similar means is disposed between the connecting arm 24 and the lifting means 18 to allow the connecting arm 24 to be adjusted as to the distance of its distal end 28 from the lifting means 18. The distal end 28 of the connecting arm 24 is bent with respect to the body portion of the connecting arm 24 so as to form a arcuate surface which can engage an actuator arm 30 upon the upward movement of the lifting means 18 but which will release the actuator arm 30 upon the downward movement of the lifting means 18.

Figure 5:
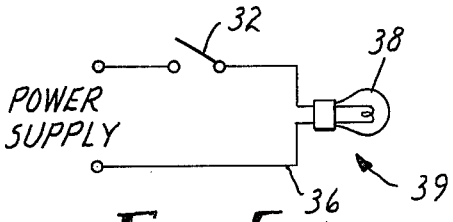
FIG. 5 is a schematic illustration of the electrical circuit according to the present invention.
Figure 3:
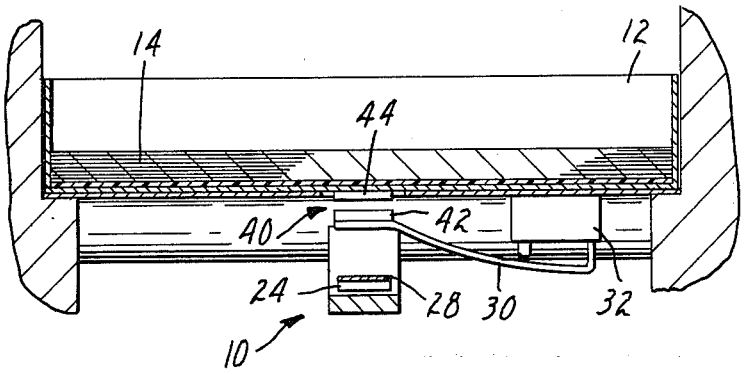
FIG. 3 is a transverse section taken along line 3—3 of FIG. 2.

The actuator arm 30 is an elongate section of flat stock, metal or plastic, having a first end mechanically connected to a switch 32 mounted within the paper feeder. The actuator arm 30 is pivotable about this first end between a first position and a second position corresponding to the "off" and "on" conditions of switch 32, such that the movement of the actuator arm 30 from its first position to its second position closes switch 32 thereby energizing an electrical circuit 36 (FIG. 5) and an associated lamp 38 comprising the indicator means 39. The lamp 38 is mounted in the control panel of a copy machine and located to be convenient for indicating a depleting or depleted paper condition to the operator of the machine.

The lamp 38 will be energized whenever the lifting means 18 travels sufficiently upward for the actuator arm 30 to approach its second position and thus close or turn on switch 32. The corresponding downward movement of the lifting means 18 allows the actuator arm 30 to descend and open or turn off switch 32 and the lamp 38. This intermittent turning on or flashing of the lamp 38, during the feeding process occurs only when the supply of paper is sufficiently depleted to allow the actuator arm 30 to reach its second position. Thus, the intermittent flashing alerts the operator of the device to the approach of a depleted paper condition.

Means 40 are provided for latching the actuator arm 30 at its second position upon a predetermined distance of upward travel by the lifting means 18. These means 40 comprise a first portion 42 affixed to the distal end of the actuator arm 30. This first portion 42 is typically a section of permanently magnetized material. A second portion 44 of the means 40, e.g. a steel disc, is affixed to a bottom of the cassette 12. These two portions of the means 40 are positioned above each other such that the actuator arm 30 can be magnetically attracted toward the cassette 12 as the lifting means 18 moves toward the cassette 12 during the sheet feeding process. This magnetic attraction occurs whenever the two portions of the means 40 are in close enough proximity for the magnetic forces to become significant. As can be seen, the adjustment screw 26 can be used to advanced the connecting arm 24 closer to the cassette 12 so as to lessen the movement required by the lifting means 18 prior to the magnetic forces becoming significant. It is important to note that the use of magnetic means to latch the actuator arm 30 in its second position does not require complex moving parts or precise alignment as would be the case if one would attempt to perform this function with a strictly mechanical counterpart.

As the supply of paper continues to be depleted the actuator arm 30 will reach a position, dependent upon the adjustment of screw 26, during its upward motion where the magnetic forces will become sufficiently strong so that the first portion 42 and the second portion 44 of the magnetic means 40 will become latched together causing the actuator arm 30 to remain adjacent to the cassette 12. The downward movement of the lifting means 18 after this latching simply disengages the connecting arm 24 from the actuator arm 30. After this dis-engagement, the actuator arm 30 is no longer responsive to the movement of the lifting means 18, and the lamp 38 will remain energized. This alerts the operator that the paper 14 within the cassette 12 has been sufficiently depleted that more paper should be added prior to continuing the paper feeding operation.

The device 10 has an added advantage in that the addition of paper does not require a complex manipulation for the operator to reset the machine. Rather simply removing the cassette 12 will remove the second portion 44 of the magnetic means 40 from contact with the magnet 42 causing the actuator arm 30 to unlatch and drop back to its first position. The re-insertion of the cassette 12, will return the second portion 44 of the magnetic means 40 and allow the paper feeder to operate until the proximity of the lifting means 18 again cause the magnetic forces to become sufficient to again latch the magnetic means 40.

It is also apparent that in addition to the indicator means 39 this device can be used with an appropriate relay or electrical circuit to actually disable the feeding process until additional paper is added.

Having thus described a preferred embodiment of this invention, it will be understood that changes may be made in the size, shape or configuration of some of the parts without departing from the present invention as described in the appended claims.

What is claimed is:

1. A device for detecting the depletion of a supply of sheets within a sheet feeder of the type wherein lifting means are utilized to lift the sheets within the sheet feeder away from a support member and toward a feed roller to afford the feeding of a single sheet; said device comprising a connecting arm mounted on the lifting means, an actuator arm disposed to be engaged by said connecting arm during the lifting motion of the lifting means, said actuator arm being pivotable between first and second relative positions, indicator means for indicating the depletion of sheets within the sheet feeder, said indicator means being connected to said actuator arm such that the movement of said actuator arm from its first position to its second position activates said indicator means, and the movement of said actuator arm from its second position to its first position de-activates said indicator means, means for magnetically latching said actuator arm at its second position upon said lifting means travelling a predetermined distance toward the feed roller.

2. A device as claimed in claim 1 further comprising adjustment means for varying the distance between a distal end of said connecting arm and the lifting means, so as to afford an adjustment of the movement required by the lifting means before said connecting arm engages said actuator arm.

3. A device as claimed in claim 1 wherein said means for latching said actuator arm comprises a permanent magnet attached to said actuator arm and a magnetic member attached to the support member, such that the removal of said support member from said sheet feeder removes said magnetic member and affords the automatic release of said actuator arm from its second position.

4. A device as claimed in claim 1 wherein said indicator means comprises a lamp disposed to be conveniently visable by an operator of said device, and an electrical switch mechanically connected to said actuator arm and electrically connected to said lamp.

5. A device for detecting the depletion of a supply of sheets within a sheet feeder of the type wherein lifting means are utilized to lift the sheets within the sheet feeder away from a support member and toward a feed roller to afford the feeding of a single sheet; said device comprising a connecting arm mounted on the lifting means, an actuator arm disposed to be engaged by said connecting arm during the lifting motion of the lifting means, said actuator arm being pivotable between first and second relative positions, indicator means for indicating the depletion of sheets within the sheet feeder, as well as for indicating the low supply of said sheets within the sheet feeder, said indicator means being connected to said actuator arm such that the movement of said actuator arm from its first position to its second position activates said indicator means, and the movement of said actuator arm from its second position to its first position de-activates said indicator means, and means for latching said actuator arm at its second position upon said lifting means travelling a predetermined distance toward the feed roller.

6. A device for detecting the depletion of a supply of sheets within a sheet feeder of the type wherein lifting means are utilized to lift the sheets within the sheet feeder away from a support member and toward a feed roller to afford the feeding of a single sheet; said device comprising a connecting arm mounted on the lifting means, an actuator arm disposed to be engaged by said connecting arm during the lifting motion of the lifting means and automatically released from said connecting arm after each sheet feeding cycle, so as to not restrain the movement of the lifting means, said actuator arm being pivotable between first and second relative positions, indicator means for indicating the depletion of sheets within the sheet feeder, said indicator means being connected to said actuator arm such that the movement of said actuator arm from its first position to its second position activates said indicator means, and the movement of said actuator arm from its second position to its first position de-activates said indicator means, and means for latching said actuator arm at its second position upon said lifting means travelling a predetermined distance toward the feed roller.

* * * * *